US007845604B2

(12) United States Patent
Connor, Jr.

(10) Patent No.: US 7,845,604 B2
(45) Date of Patent: Dec. 7, 2010

(54) PROTECTIVE FENCE HANGER

(76) Inventor: Robert T. Connor, Jr., 352 Harbor Rd., Staten Island, NY (US) 10303

( * ) Notice: Subject to any disclaimer, the term of this patent is extended or adjusted under 35 U.S.C. 154(b) by 32 days.

(21) Appl. No.: 12/079,711

(22) Filed: Mar. 28, 2008

(65) Prior Publication Data

US 2008/0245937 A1 Oct. 9, 2008

Related U.S. Application Data

(60) Provisional application No. 60/908,420, filed on Mar. 28, 2007.

(51) Int. Cl.
*A47B 96/06* (2006.01)

(52) U.S. Cl. ..... 248/215; 248/219.3; 248/304; 211/85.23

(58) Field of Classification Search ..... 248/215, 248/219.2, 219.3, 317, 320, 301, 304; 211/113, 211/118, 85.23, 85.29, 119.004; 47/67; 108/44, 108/152
See application file for complete search history.

(56) References Cited

U.S. PATENT DOCUMENTS

| | | | | | |
|---|---|---|---|---|---|
| 846,784 | A * | 3/1907 | Davis | 182/152 |
| 1,343,363 | A | 6/1920 | Hall | |
| 2,327,253 | A * | 8/1943 | Eisel | 482/24 |
| 3,746,179 | A * | 7/1973 | Paumgardhen | 211/75 |
| 3,873,737 | A * | 3/1975 | Hofmann et al. | 426/105 |
| 3,897,056 | A * | 7/1975 | Hock et al. | 472/118 |
| 4,846,430 | A * | 7/1989 | Ke | 248/215 |
| 4,896,456 | A | 1/1990 | Grant | |
| D314,359 | S * | 2/1991 | Viglianti et al. | D11/212 |
| 5,269,229 | A * | 12/1993 | Akapatangkul | 108/44 |
| 5,390,443 | A | 2/1995 | Emalfarb et al. | |
| 5,443,018 | A * | 8/1995 | Cromwell | 108/44 |
| 5,628,380 | A * | 5/1997 | Matisi | 182/70 |
| 5,711,502 | A | 1/1998 | Emalfarb et al. | |
| 6,216,886 | B1 | 4/2001 | Considine | |
| 6,299,118 | B1 * | 10/2001 | Farrell | 248/327 |
| 6,659,412 | B1 | 12/2003 | Roach | |
| 6,679,188 | B1 * | 1/2004 | Spagnoli, Jr. | 108/44 |
| D503,287 | S * | 3/2005 | Gouldson | D6/328 |
| 2005/0222654 | A1 * | 10/2005 | Brown | 607/109 |
| 2005/0284899 | A1 * | 12/2005 | Fleming et al. | 223/85 |
| 2006/0049124 | A1 * | 3/2006 | Wang | 211/113 |
| 2006/0207956 | A1 * | 9/2006 | Sivers | 211/113 |

OTHER PUBLICATIONS

Pending Mar. 27, 2008 Connor, Jr. To Go Abandon.

* cited by examiner

*Primary Examiner*—Korie Chan
(74) *Attorney, Agent, or Firm*—James Ray & Assoc

(57) ABSTRACT

A protective hanger apparatus for use with fence posts includes an elongated substantially rectangular flexible main body, wherein the main body defines or engages with a top loop having dimensions enabling it to fit over the top of and be supported from a fence post. The main body further includes least two lateral rectangular apertures in this main body having a predetermined height and width such as to be removably engageable with at least one included item hanger.

16 Claims, 4 Drawing Sheets

PROTECTIVE FENCE HANGER

CROSS REFERENCE TO RELATED APPLICATION

This patent application is related to and claims priority from U.S. Provisional Patent Application Ser. No. 60/908,420 filed Mar. 28, 2007.

FIELD OF THE INVENTION

The present invention relates, in general, to apparatus for hanging articles from fences and, more particularly, this invention relates to hangers for fence posts that provide aesthetic display or storage of items without fence or post damage.

BACKGROUND OF THE INVENTION

Prior to the conception and development of the present invention, it has been commonplace for homeowners to lean or hang certain items along fences surrounding all or part of their yards. Hanging keeps those items off the ground and offers a neater appearance, but could result in damage to the fence.

Over the years, many devices have been devised for hanging items from fences or fence posts. For example, U.S. Pat. No. 4,896,456 discloses a plant growing system designed to be hung from multiple elongated slotted supports hung from the top of a fence. The described system requires two vertical supports to hold up one plant potting receptacle. Also, it hangs off the fence itself and would not work well with picket style fences. The same drawbacks apply to the hanger disclosed in U.S. Pat. No. 6,659,412.

Others have disclosed wire type fence or railing hangers that are lacking in aesthetics and versatility, and they also could scratch or mar certain types of fences. Examples illustrating these designs are U.S. Pat. Nos. 1,343,363, 5,390,443, and 5,711,502. U.S. Pat. No. 6,216,886 discloses a post-mounted hanging device that attaches semi-permanently to the top of a post that is flat on top and offers very limited hanging options. In recent years, white vinyl fencing in numerous height and styles has become very popular. The posts are typically very strong, but the fence panels themselves may not be suitable for supporting heavier items, such as ladders.

SUMMARY OF THE INVENTION

The present invention provides a protective hanger apparatus for use with fence posts, and includes an elongated substantially rectangular flexible main body having a length less than that of the above-ground portion of the post, wherein the main body defines or engages with a top hoop having dimensions enabling it to fit over the top of and be supported from a fence post. The main body further includes least two lateral rectangular apertures in this main body having a predetermined height and width such as to be removably engageable with at least one included item hanger.

In an even more preferred embodiment, the main body has long front and back panels wherein the front panel has the hanging apertures and the rear panel adds a layer of fence and post protection. In an alternative embodiment of the invention, the hanger has two main parts: an inverted U-shaped member with much of the leg portions attached to the longitudinal edges of a web with a multiplicity of hanging slots in the web. In yet another similar embodiment, the U-shaped top portion is substantially rigid and bent approximately 90 degrees to the plane of the web portion. In all embodiments, it is preferable to have the bottom of the hanger secured to the fence or post so as to keep the main body taut even when heavy items are hung on it.

OBJECTS OF THE INVENTION

It is, therefore, one of the primary objects of the present invention to provide a convenient and attractive apparatus for hanging items along a fence while also offering a degree of protection from potential damage to the fence or posts by the hanging items.

Another object of the present invention is to provide a hanging device for fences requiring no tools to install and thus is easy to install and relocate.

Still another object of the present invention is to provide an attractive protective hanger for fences with adjustable hanging height features.

Yet another object of the present invention is to provide a versatile hanging system for fences that can accommodate a variety of hanger attachments, some being included.

An additional object of the present invention is to provide a protective hanger system, for PVC fences in particular, which can be readily rolled into a compact shape for packaging and storage.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
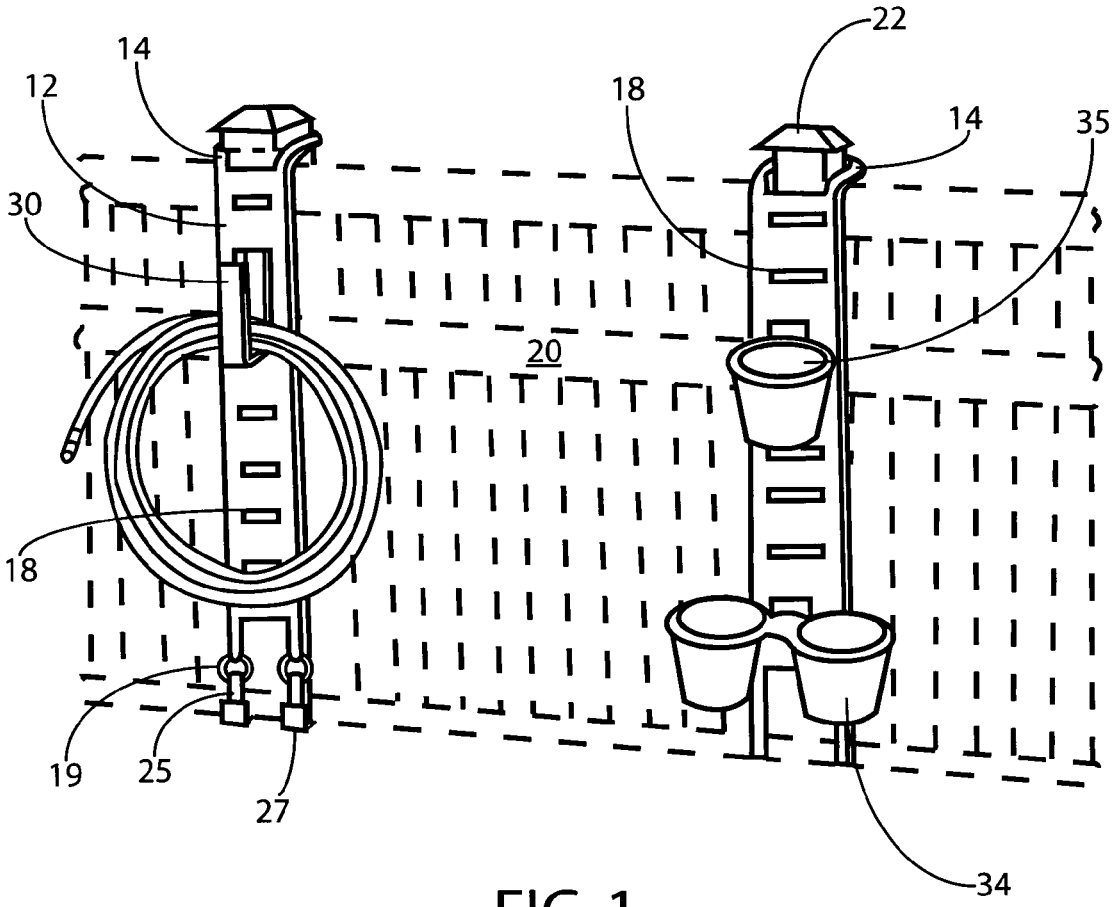
FIG. 1 is a perspective view of the present invention in use on a fence having multiple posts.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Referring initially to FIG. 1, this offers a perspective view of the present invention in use on a fence 20 having posts 22.

The top end 14 forms a U-shaped loop that that bends, hooks over, and is suspended from a post 22. An elongated flexible main body 12 defines substantially parallel longitudinal edges, and slots or windows 18 in the main body 12 allow for engaging with hooks on attachment devices 30 and 34. Attachment devices like 30 can be used for storing items such as hoses, or ladders when the hangers are used in pairs. Potted plants can be supported by attachments such as 34 and/or 35. In certain cases, such as with heavy pots hung along the lower half, a bottom tie down 25 may not be necessary, but is generally preferred. The free ends of the longitudinal sides can optionally include provisions for securing the hanger to either the fence post 22 or the bottom of the fence 20. One example is shown, with clips 27 that engage the bottom of the fence. The clips are connected to adjustable flexible straps 25 that are movably attached to rings 19.

Figure 2:
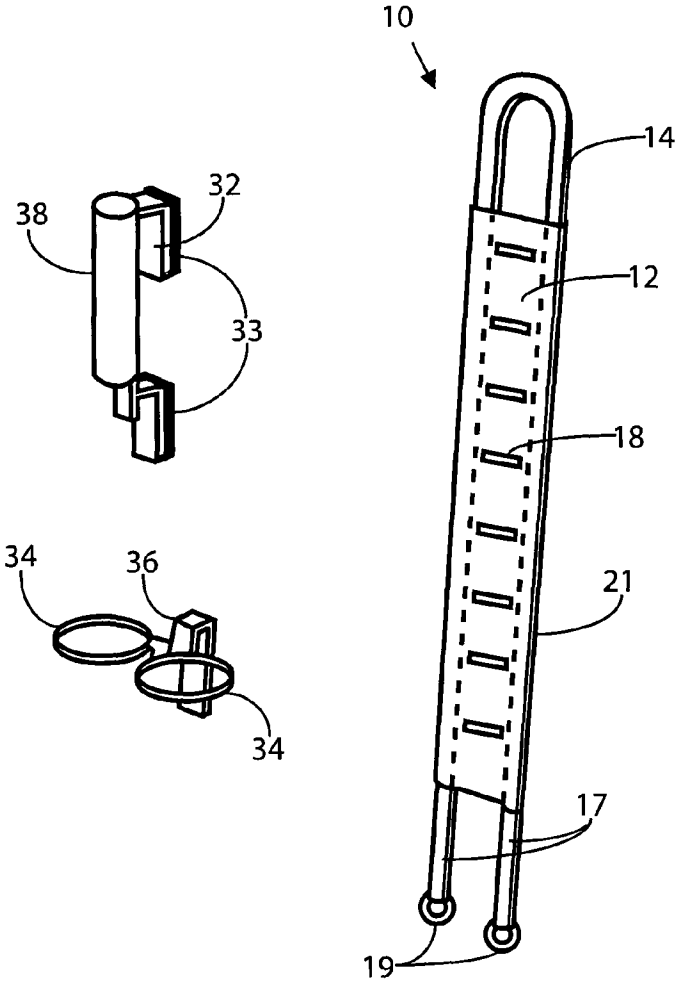
FIG. 2 is substantially an exploded view of one embodiment of the present invention with two exemplary attachments.

FIG. 2 depicts a preferred embodiment of the present invention, generally indicated by 10, with two separated exemplary attachments, a double pot holder 36 and a flag or torch holder 38. Numerous other attachments could also be utilized with the main hanger body and no limit to such attachments is implied. A key feature of the hangers is providing a layer of protection between the fence and hanging items to prevent marring and damage to the fence 20 and posts 22. This protection comes in part from the material of construction of the main body, and can be augmented by resilient coverings 33 on the back side of tabs 32 and/or a protective panel 21 on the back side of main body 12.

An elongated U-shaped flexible member 14 is covered over much of its length of three to six feet with a flexible web 12 that covers most of the gap between the parallel legs of the U-shaped member 14 down to the leg extensions 17 at the distal end of member 14. This keeps the legs 17 spaced about four to eight inches apart with six inches generally preferred. A multiplicity of slots 18 are formed in the web 12 substantially perpendicular to the legs 17. The slots 18 typically extend across more than half the width of the web 12, and open 10 to 20 millimeters in height. Slots 18 are generally spaced six to eight inches apart. The flexible member 14 and flexible web 12 are typically made of a weatherable, durable fabric or flexible plastic material. Preferred materials would be nylon, rubber, or plasticized PVC, but many others would be suitable as well. The web 12 can be either a single layer or a dual layer with slots in the front side only. In the dual-layer configuration, the back side 21 would commonly be an integral part of the main body web 12, but there would be a gap between the two layers wide enough to allow the tabs 32 of the hanger accessories to fit in between. The main purpose of the back side 21 is to prevent damage or marring of the fence posts. Each of the two distal ends of legs 17 optionally have at least one tie-down ring 19 for securing the hanger in position after the U-shaped end is placed over the top of a fence post. The ring ends 19 would attach to cords, straps, or elastic straps with clips, as detailed in FIG. 6, that engage with the fence posts or the bottom of fence. The attachments that engage with the slots 18 at the desired height can be of many forms, such as a flag or torch holder 38, or plant support rings 34. A tab 32 on the back side of the hanger attachments is narrower than the length of the slot 18 and thinner than the width of the slot.

Figure 3:
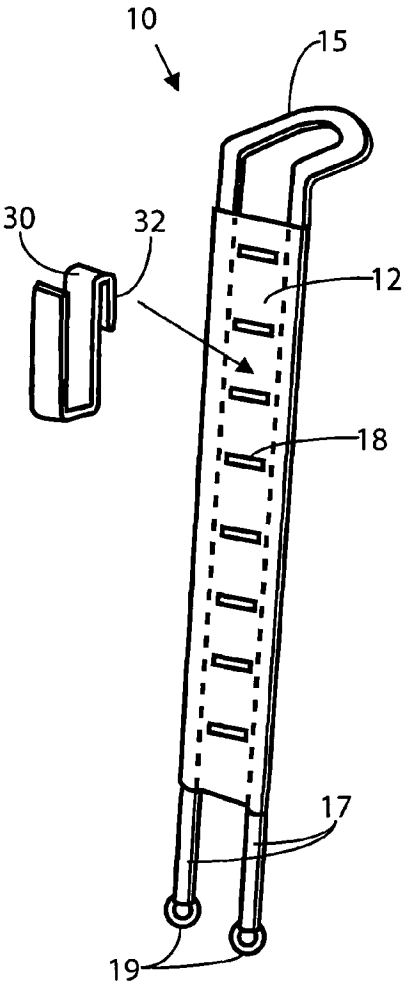
FIG. 3 presents a perspective view of an alternative embodiment of the invention.

FIG. 3 provides a perspective schematic of an alternative embodiment, generally shown as 10, with an attachment 30 engageable in slot 18 of web 12. By bending the web 12, the hanging tab 32 on double-U attachment 30 can be slid into any of the slots 18. Two elongated parallel legs 17 are fixedly attached to a web 12 that hold the flexible legs 17 parallel at a separation of approximately four to eight inches apart with six inches generally preferred. A multiplicity of slots 18 substantially perpendicular to the legs 17 are spaced along the length of the web 12. The preferred spacing of the slots is about six inches. The slots typically open about ten to twenty millimeters in height and extend across half or more of the width of the main body web 12. At the free ends of the legs 17 are rings 19 that can engage straps or cords that enable securing the hanger to a fence post or bottom of the fence. At the top end of the hanger, a preformed substantially rigid loop 15 would engage with top of the fence posts without the necessity of bending anything. This would facilitate installation and removal by short people with tall fences.

Figure 4:
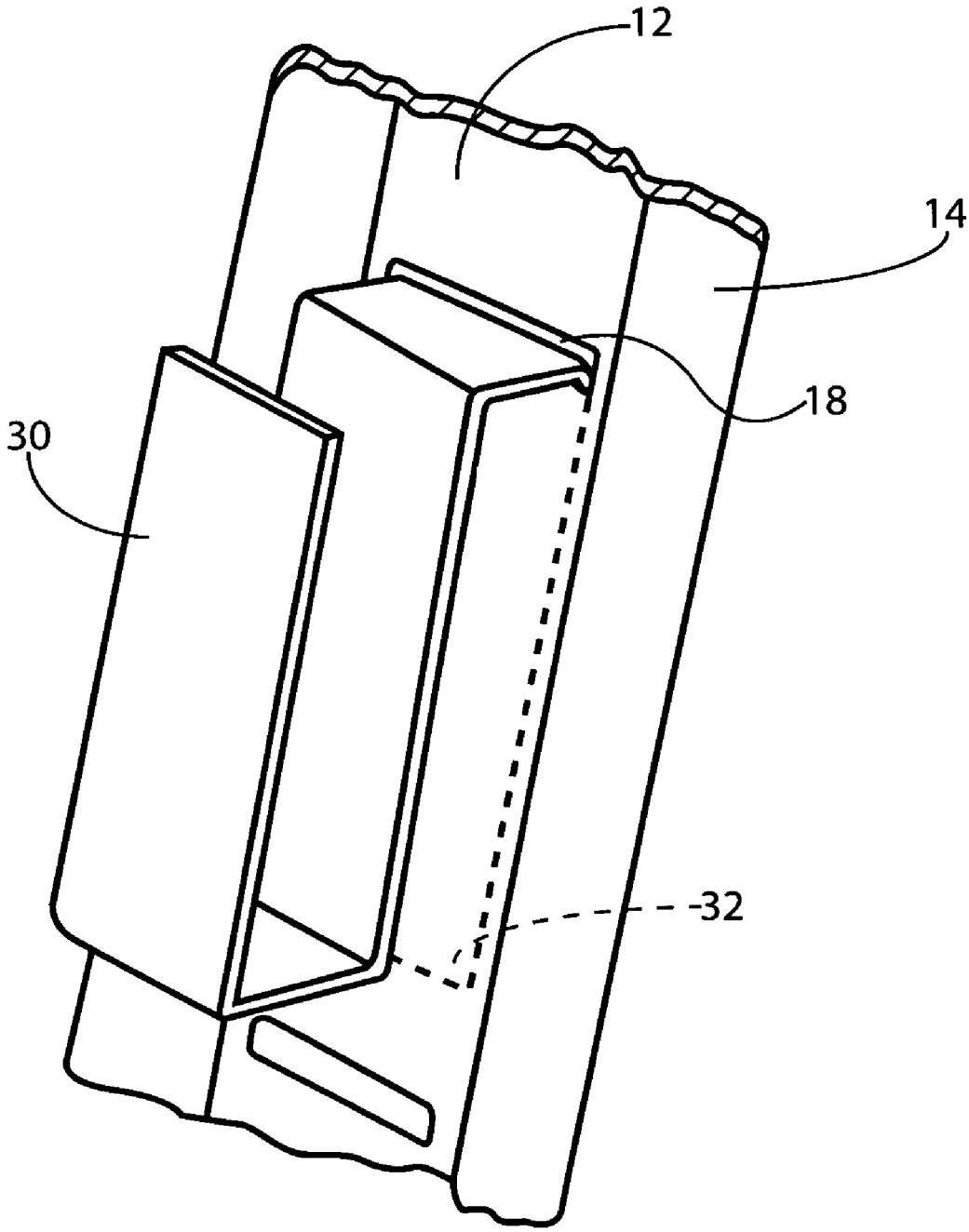
FIG. 4 is an enlarged view of a segment of the hanger and a hanging hook attachment.

FIG. 4 provides an enlargement of a segment of a hanger with one hanging attachment 30 disposed in the slot 18 with the hanging tab 32 on the opposite side of the web material 12.

Figure 5:
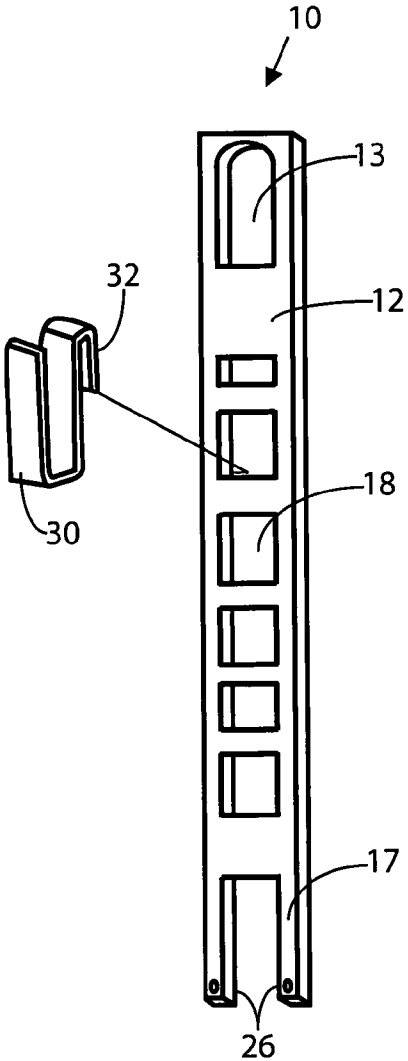
FIG. 5 provides a perspective elevation view of a preferred embodiment of the present invention.

FIG. 5 provides an elevation perspective view of an alternative embodiment of the invention shown generally as 10. The hanger apparatus 12 is essentially all one piece with cut-out sections forming a top window 13 for hanging over the top of a fence post. The apparatus 12 will most likely be a rubber-like mat material and may have protrusions from the back to create a protective gap between the fence and the back of hanging tab 32. There are also slots or small windows 18 cut out for accommodating the removable installation of one or more hanging attachments such as the double-U shaped hook 30 with a tab 32 that engages with the lower horizontal edge of slot 18. Optional lower legs 17 can be cut in also, and optional methods 26 of securing to the fence or post could be included, such as cord or straps.

Figure 6:
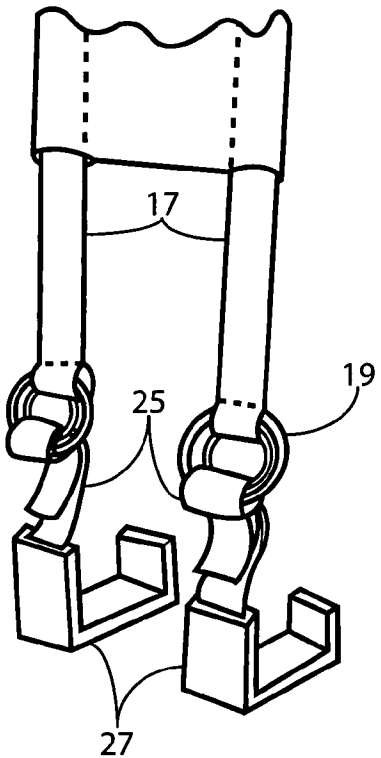
FIG. 6 provides a perspective view of an auxiliary hold-down attachment for a preferred embodiment of the present invention.

An auxiliary hold-down accessory for the present invention is illustrated in FIG. 6. Dual rings 19 at the ends of legs 17 are used to attach adjustable straps 25 connected to U-shaped clips 27 that engage with the bottom of a fence as depicted in a portion of FIG. 1. The straps 25 are preferably adjustable and can be tightened once the clips 27 are in place.

Figure 7:
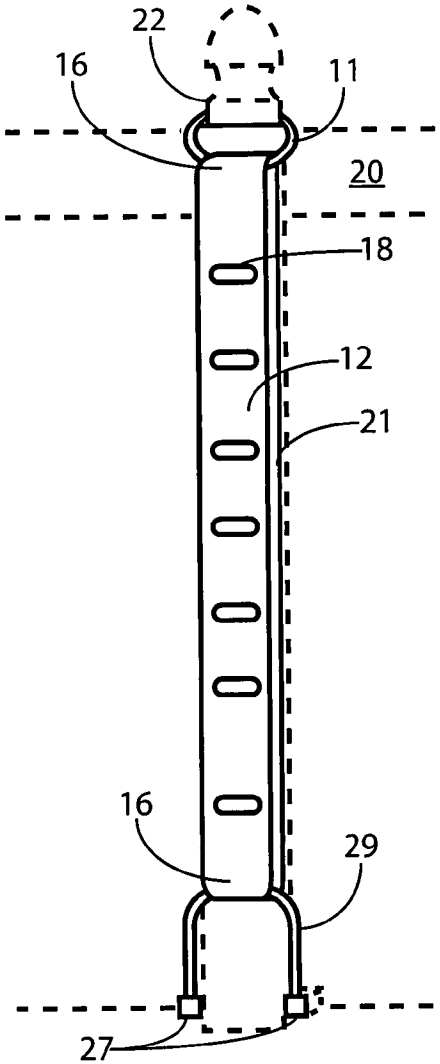
FIG. 7 provides an elevation perspective view of the most preferred embodiment of the hanger portion of the invention.

FIG. 7 illustrates the most preferred embodiment of the main portion of the hanger apparatus. The main body 12 is a durable weather-resistant flexible strap about the width of the fence post and slightly shorter than the fence 20 to which it will be adjacent when in use. The front panel main body 12 has lateral slots 18 for engaging with various types of hangers as described previously. The main body 12 is preferably one continuous long flexible belt stretched to form a front panel of the main body 12 and a back panel 21, plus top and bottom loops 16. The hanging hoop 11 is sandwiched into a bend 16 at the top end, or a top loop of the main body belt 12, while an elastic or adjustable band 29 is sandwiched into a bend 16 positioned at the lower end of the main body 12. The main body 12 will be fabricated in various lengths for fitting various heights of fences, typically in the range of three to six feet. In this design, the back portion of the long belt 21 provides a layer of protection between the fence post 22 and the backs of the hanging attachments, not shown in this view, but the same as in prior figures. In a similar alternative variation, lateral sleeves are sewn into the top and bottom edges 16 of the main body 12, which in this case may be a single long, wide strap. The main body may be constructed of nylon fabric or any of a number of similar pliable materials. A hoop 11, which can be either flexible or substantially rigid, is either sewn into or threaded through a sleeve 16 at the upper end such that the hanger 12 can be suspended from the top of post 22. In the sleeve 16 at the bottom, an adjustable band 29 is disposed with two free ends connected to rigid clips 27 which engage with the bottom of fence 20 to hold the hanger body 12 taut. The band 29 can be adjustable in length by being elastic or having common types of buckles or pairs of rings as shown in FIG. 6 above.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

What is claimed is:

1. A protective hanger apparatus for use with fence posts, said hanger apparatus comprising:

a) an elongated substantially rectangular flexible main body having a predetermined first width and a predetermined length, wherein said main body defines two lower legs and a top inverted U-shaped loop having predetermined dimensions and engageable with such fence post;

b) at least two lateral substantially rectangular apertures in said main body having a predetermined height and a second predetermined width;

c) at least one preselected item hanger removably engageable with said rectangular apertures; and, d) a hold-down means engageable with said lower legs for securing said lower legs to one of said fence posts and associated fence panels.

2. The protective hanger apparatus, according to claim 1, wherein said first predetermined width is between about three and twenty-five centimeters.

3. The protective hanger apparatus, according to claim 1, wherein said predetermined length is between about two feet and eight feet.

4. The protective hanger apparatus, according to claim 1, wherein said predetermined height is greater than 2 millimeters and less than ten percent of said predetermined length.

5. The protective hanger apparatus, according to claim 1, wherein said second predetermined width is between about two centimeters and ninety percent of said first predetermined width.

6. The protective hanger apparatus, according to claim 1, wherein said predetermined dimensions of said inverted U-shaped loop are greater than two inches and less than twelve inches in one of height, width, and arc diameter.

7. The protective hanger apparatus, according to claim 1, wherein said preselected item hanger is one of a substantially rigid double-U shaped hook, at least one rigid support hoop connected to an inverted-U clip, and a tube connected to two inverted U-shaped clips.

8. A hanger apparatus for use with fence posts, said hanger apparatus comprising:

a) an elongated flexible continuous belt having a first predetermined width and defining a front vertical panel, a back vertical panel, a top loop and a bottom loop;

b) a hanging hoop greater in diameter than said fence posts, said hoop being disposed within said top loop;

c) at least two lateral substantially rectangular apertures in said front vertical panel having a predetermined height and a second predetermined width; and d) at least one preselected item hanger removably engageable with said rectangular apertures.

9. A protective hanger apparatus for use with fence posts, said hanger apparatus comprising:

a) an elongated substantially rectangular flexible main body having a predetermined first width and longitudinal edges having a predetermined length;

b) at least two lateral rectangular apertures in said main body having a predetermine height and a second predetermined width;

c) an elongated U-shaped member, wherein legs of said U-shaped member are fixedly connected to at least 50 percent of said longitudinal edges of said main body such as to leave an uncovered totally framed top window of predetermined dimensions at an arcuate end; and d) at least one preselected item hanger removably engageable with said rectangular apertures.

10. The protective hanger apparatus, according to claim 9, wherein free ends of said legs further include attachment means for securing bottom of said hanger apparatus to one of said fence posts and associated fence panels.

11. The protective hanger apparatus, according to claim 10, wherein said attachment means are rings engageable with straps and clips.

12. The protective hanger apparatus, according to claim 10, wherein said attachment means are apertures engageable with tie down cords and bands.

13. The protective hanger apparatus, according to claim 9, wherein said preselected item hanger is one of a substantially rigid double-U shaped hook, at least one support hoop connected to an inverted-U clip, and a tube connected to inverted-U clips.

14. The protective hanger apparatus, according to claim 9, wherein said arcuate end of said elongated U-shaped member is fixedly disposed substantially perpendicular to flexible legs of said U-shaped member.

15. The protective hanger apparatus, according to claim 9, wherein said predetermined dimensions of said uncovered window are greater than two inches and less than twelve inches in one of height, width, and arc diameter.

16. The protective hanger apparatus, according to claim 9, wherein said predetermined length is between about two feet and eight feet.

* * * * *